United States Patent [19]

Narisoko et al.

[11] Patent Number: 4,753,180

[45] Date of Patent: Jun. 28, 1988

[54] METHOD OF STABLE COMBUSTION FOR A FLUIDIZED BED INCINERATOR

[75] Inventors: Minoru Narisoko, Matsudo; Satoshi Inoue, Asaka; Mikio Kiyotomo, Matsudo, all of Japan

[73] Assignee: Ishikawajima-Harima Heavy Industries Co., Ltd., Tokyo, Japan

[21] Appl. No.: 1,062

[22] Filed: Jan. 7, 1987

[30] Foreign Application Priority Data

Jan. 21, 1986 [JP] Japan ..... 61-008947

[51] Int. Cl.[4] ..... F23C 11/02

[52] U.S. Cl. ..... 110/346; 110/245; 110/263; 122/4 D

[58] Field of Search ..... 110/346, 285, 263, 203, 110/210; 122/4 D; 431/7, 170; 34/57 A; 432/15, 58; 60/39.464; 165/104.16

[56] References Cited

U.S. PATENT DOCUMENTS

| | | | |
|---|---|---|---|
| 3,893,426 | 7/1975 | Bryers | 122/4 D |
| 3,910,235 | 10/1975 | Highley | 122/4 D |
| 4,249,472 | 2/1981 | Mitchell | 122/4 D X |
| 4,267,801 | 5/1981 | Robinson | 110/245 X |
| 4,344,372 | 8/1982 | Chronowski | 122/4 D X |
| 4,499,857 | 2/1985 | Wormser | 122/4 D |
| 4,505,230 | 3/1985 | Caplin | 122/4 D |
| 4,528,945 | 7/1985 | Virr et al. | 122/4 D |
| 4,561,385 | 12/1985 | Cross et al. | 122/4 D |

*Primary Examiner*—Steven E. Warner

*Attorney, Agent, or Firm*—Cullen, Sloman, Cantor, Grauer, Scott & Rutherford

[57] ABSTRACT

A method of stable combustion in a fluidized bed incinerator for burning and decomposing refuse such as municipal wastes while fluidizing them is disclosed. A number of air diffuser tubes are provided inside the incinerator body for fluidizing the refuse and the fluidizing medium. The fluidizing air from the air diffuser tubes is supplied at high speed or low speed from each of the tubes respectively. By alternately forming more and less fluidized areas inside the fluidized bed, the refuse is stably burned. Because of the stable combustion of the refuse, the combustion air ratio can be reduced and the combustion chamber temperature inside the incinerator can be maintained at a high level.

8 Claims, 3 Drawing Sheets

METHOD OF STABLE COMBUSTION FOR A FLUIDIZED BED INCINERATOR

FIELD OF THE INVENTION

This invention relates to a method for incinerating substances such as municipal and industrial wastes (called "refuse" hereinafter) while fluidizing them inside a fluidized bed incinerator. More particularly, it is concerned with a method for a stable combustion in a fluidized bed incinerator.

BACKGROUND ART

The use of a fluidized bed incinerator for disposing of refuse such as municipal wastes is known. The method for incinerating and disposing the refuse in such fluidized bed incinerator comprises burning the refuse with air while fluidizing it in a fluidized bed. In order to improve the combustion along with the fluidizing of refuse, a fluidizing medium such as sand is fed together with the refuse to the fluidized bed.

A typical type of fluidized bed incinerator is equipped with a plurality of air diffuser tubes or plates in the lower section of the incinerator body, and the upper section of the incinerator body is equipped with a refuse feeding unit and a fluidizing medium feeding unit.

The refuse is burned while both the refuse and the fluidizing medium deposited into the air diffusers inside the incinerator body are fluidized by primary air which is blown out through the air diffusers.

Refuse in the form of municipal waste generally contains a variety of materials such as low calorie refuse, e.g. food discards, high calorie refuse such as plastics and rubber, refuse such as shredded paper and chipped furniture, or refuse such as fragmented metallic or vitreous containers, bottles, or cans.

As the refuse is fed to the fluidized bed, the combustibles are burned, of which the plastics and similar substances are melted by heat to generate pyrolysis gases, and the incombustible substances like glass are left unburned (called "combustion residue" hereinafter).

The fluidizing medium descends as it is gradually fed to the fluidized bed. Consequently, while the combustibles are burned and decomposed within the fluidizing bed, the incombustibles descend along with the fluidizing medium down through the incinerator and pass through the gaps among air diffuser tubes in the lower section of the fluidized bed. The fluidizing medium is separated from combustion residue, and is returned to the fluidized bed.

Secondary air is fed to an upper section of the incinerator above the fluidized bed in order to burn the pyrolysis gases.

Because the fluidizing medium fed to the fluidized bed is heated and oscillated while it descends, agitation and dispersion of the refuse is promoted. As a result, the refuse deposited onto the fluidized bed is dispersed uniformly through the fluidizing medium, and is therefore dried, ignited, decomposed, and burned instantly. Further, the resulting ashes and dust are carried by the fluidizing air out of the upper section of the incinerator and are collected by an electric precipitator.

Consequently, the refuse deposited onto the fluidized bed is disposed almost completely, leaving behind some metallic, vitreous, or ceramic residue. The ratio of these latter-mentioned substances to the refuse is usually 2%, thus incineration by a fluidized bed incinerator can dispose of 98% of the refuse. In fact, one of the advantages of the fluidized incinerator is that the volume of combustion residue can be reduced to one-third compared with a conventional mechanical incinerator such as a stoker-type incinerator.

Because the refuse deposited onto the fluidized bed is burned and decomposed rapidly, the refuse cannot be burned stably. The refuse has different calorific value depending on the content of the refuse, and it is often difficult to consistently supply a constant volume of refuse to the fluidized bed. For example, if a large quantity of refuse is introduced to the fluidized bed at once, a large quantity of pyrolysis gases and smut are also generated simultaneously, and the refuse undergoes pyrolysis instantaneously. Under these conditions, not only is it impossible to completely combust a large quantity of pyrolysis gas with the secondary air inside the incinerator, but it is also difficult to collect all of the large quantity of smut in exhaust gas by means of an electric precipitator.

SUMMARY OF THE INVENTION

The principal object of this invention is to provide a method for burning and decomposing the refuse slowly in the fluidized bed in order to achieve stable incineration.

Another object is to provide a method for combustion in a fluidized bed incinerator which is capable of controlling the fluidization between the refuse and the fluidizing medium inside the fluidized bed, and of achieving stable, slow combustion of the refuse.

In addition, another object is to provide a method of stable combustion for a fluidized bed incinerator that is capable of reducing the volume of air supplied to the incinerator and which is capable of maintaining the temperature of pyrolysis gas in the combustion chamber at a high level.

In order to attain the above objects, a method is provided for stable combustion in a fluidized bed incinerator of the type wherein fluidizing air is blown out from parallel diffuser tubes provided inside the incinerator, and refuse such as municipal waste is fluidized with a fluidizing medium and fluidizing air, and is then burned. According to the method of the present invention, high speed fluidizing air and low speed fluidizing air are blown from alternate diffuser tubes, and the air flow speed is changed cyclically from high to low or from low to high.

DESCRIPTION OF THE PREFERRED EMBODIMENT

An example of the preferred embodiment of a method for stable combustion in a fluidized bed incinerator according to this invention will now be described with reference to the attached drawings.

Figure 1:
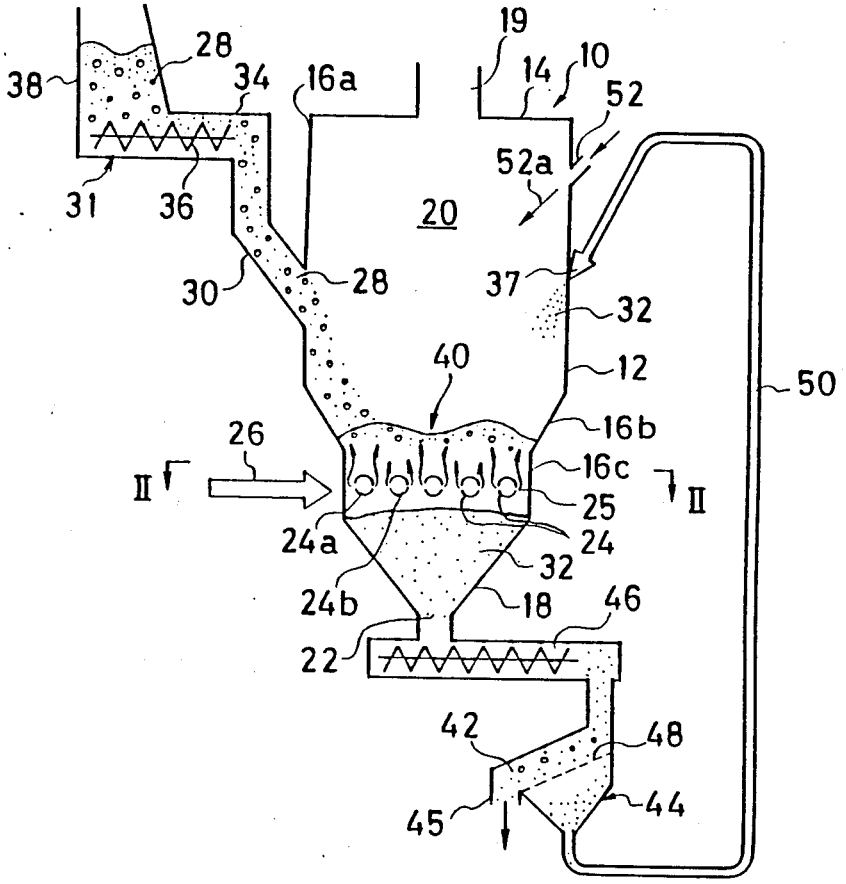
FIG. 1 is a schematic sectional view of an incinerator used to practice the method according to the present invention.

In FIG. 1, the reference numeral 10 designates an incinerator body comprising refractor walls 12, rectangular top wall 14, side walls 16 and an inverted rectangular pyramidal bottom wall 18 connected to the lower section of the side walls 16.

The side walls 16 comprise upper wall 16a in which a combustion chamber 20 is formed, wall 16b, which is inclined inwardly from the upper wall 16a, and a vertical wall extending vertically from the lower section of the inclined wall 16b and connected with the bottom wall 18.

An exhaust port 19 is provided in the top wall 14, and a discharge port 22 is provided at the lower section of the bottom wall 18.

In the space enclosed by the vertical wall 16c, a large number of parallel air diffuser tubes 24 are provided to blow out primary air in order to form a fluidized bed 40.

The air diffuser tubes 24, which extend through the vertical wall 16c and out of the incinerator body 10, are connected with a fluidizing air charging source 26.

Longitudinally spaced nozzle holes 25 are provided on either side of air diffuser tubes 24.

A duct 30 is connected to the upper section wall 16a of incinerator body 10 to feed refuse 28, such as municipal wastes, to the combustion chamber.

A precipitator 31 comprises a casing 34 connected with the duct 30 and a screw 36. The casing 34 has a hopper section 38 for receiving the refuse 28. The refuse 28 introduced into the hopper section 38 is transferred to the duct 30 by the rotation of screw 36, via the duct 30, and is thence fed onto the air diffuser tubes 24.

On the upper section of the wall 16a of the incinerator body 10, a charging port 37 is provided for supplying fluidizing medium such as sand into the incinerator body 10. The fluidizing medium 32 is fed onto the air diffuser tubes 24 through the charging port 37 from a later described circulation unit.

The refuse 28 and the fluidizing medium 32 that are fed onto the air diffuser tubes 24 are fluidized by the fluidizing air blown out of the nozzles 25 of the air diffuser tubes 24, thereby forming the fluidized bed 40.

A screw conveyor 46, for transferring to a separator 44 the combustion residue within the fluidizing medium 32 and the refuse which streams down through the gaps between air diffuser tubes 24, is connected to a discharge port 22 in the bottom of the incinerator body 11.

The separator 44 contains a sieve 48 which separates the fluidizing medium 32 form the combustion residue 42. The combustion residue 42 remains on the sieve 48 and is discharged from the separator 44 through a discharge port 45. The fluidizing medium 28, after passing through the sieve 48, is fed back to the fluidized bed 40 via the charging port 37 and a circulation line 50 which may include a vertical conveyor, etc. that is connected to the separator 44.

Secondary air is introduced into the combustion chamber 20 formed in the upper portion of the incinerator body 10 by air intake nozzles 52 which are installed in the upper wall 16a.

Figure 2:
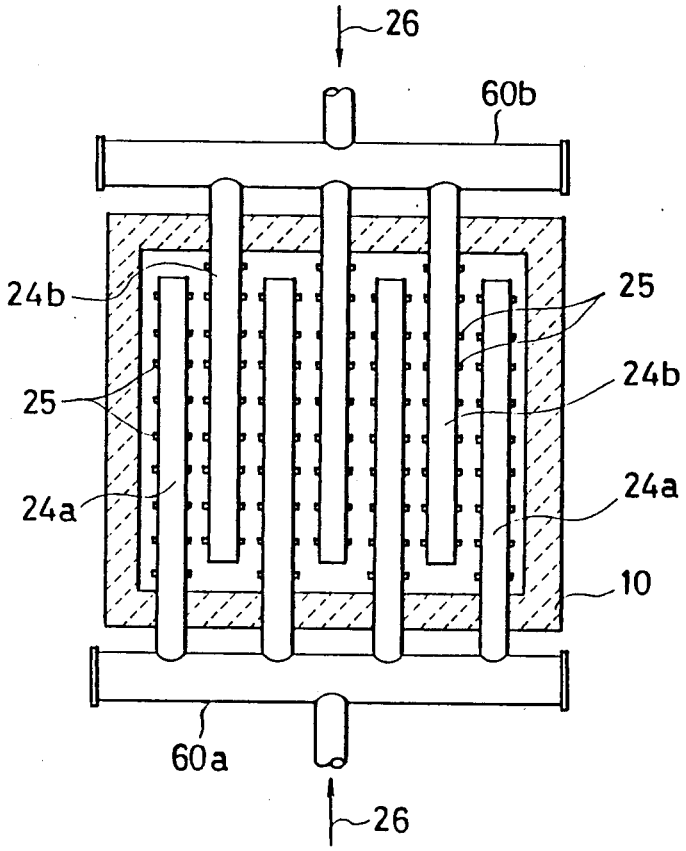
FIG. 2 is a sectional view taken along the line II—II of FIG. 1.

As shown in FIG. 2, a first header 60a and a second header 60b are respectively installed on opposite sides of the incinerator body 10 to supply the fluidizing air at both low speeds and high speeds. Two alternating sets of air diffuser tubes 24a and 24b are respectively connected to headers 60a and 60b.

The first header 60a and the second header 60b are connected to the air charging source 26 shown in FIG. 1. The air charging source 26 has a switching unit comprising a valve (not shown) for cyclically supplying the fluidizing air at high and low pressure alternately from the first header 60a and the second header 60b. Therefore, when the fluidizing air is blown out from each nozzle 25 of the air diffuser tubes 24a at high speed, the fluidizing air is blown out from each nozzle 25 of air diffuser tubes 24b simultaneously at low speed, and, conversely, when the fluidizing air is blown out of each nozzle of air diffuser tubes 24a at low speed, the fluidizing air is blown out of each nozzle 25 of air diffusion tubes 24b at high speed.

The interval of blowing, changing high speed to low speed, or low speed to high speed, should preferably be between ten seconds to three minutes.

"um", the speed of fluidizing air blown out of the nozzles 25 of air diffuser tubes 24a and 24b, is set to un/umf=1.0 to 2.5, at the high speed, at to um-/umf=0.5 to 1.5 at the low speed, where "umf" is the starting speed for fluidizing.

The primary air blown out through air diffuser tubes 24 and the secondary air blown out through nozzles 52 are adjusted to a ratio from 2:3 through 3:2, and preferably at a ratio of 1:1, and further, the total air ratio is adjusted to between 1.4 to 1.7 times the theoretical air volume for burning the refuse.

The method of burning the refuse in the aforesaid fluidized bed incinerator will now be described. The refuse 28 is fed through the duct 30 and onto the air diffuser tubes 24 inside incinerator body 10, while the fluidizing medium 32 is fed from the charging port 37 through the circulation line 50.

The fluidizing air is supplied to air diffuser tubes 24a and 24b from the air charging source 26 and is blown out through each nozzle 25 of air diffuser tubes 24a and 24b alternately at high speed and low speed.

Both the refuse 28 and the fluidizing medium fed to the air diffuser tubes 24 are fluidized by the primary fluidizing air from the nozzles 25.

A number of start-up burners (not shown) are provided inside the incinerator body 10 to commence the burning of the refuse 28 inside the fluidized bed 40 when the operation is started. Once the refuse 28 inside the fluidized bed 40 starts burning with the fluidizing air, ignition by the start-up burners is ceased.

The refuse 28 is partly decomposed into a pyrolysis gas by the combustion heat in the fluidized bed 40. This pyrolysis gas contains combustible gases such as $H_2$, CO and hydrocarbonaceous gases which are burned with the secondary air blown form the nozzles 52 into the combustion chamber 20 of the upper section inside the incinerator body 10, as shown by the arrow 52a.

The total air ratio required for combusting the refuse 28 is conventionally 1.7 to 2.0 times the theoretical air volume of the refuse 28; however, this ratio can be lowered to 1.4 to 1.7 according to the present invention, and the temperature inside the free-board area (combustion chamber) can be maintained at a high level.

The exhaust gas generated by the combustion of refuse 28 and the combustion of pyrolysis gas is exhausted to the outside through the exhaust port 19. Since this exhaust gas has high calorific value, it can be used as a heat source for heating the water of a boiler and the like. In addition, since smut is contained in the exhaust gas, dust can be removed from the gas by an electric precipitator after it is used as a heat source.

The refuse 28 and the fluidizing medium 32 are fed sequentially to the fluidized bed 40, and the refuse 28 is burned and decomposed as mentioned earlier.

The fluidizing medium 32 promotes the agitation and dispersion of the refuse 28, and also forms a moving bed descending inside the fluidized bed 40. The fluidizing medium 32 streams down, together with the combustion residue 42, through the gaps between the air diffusers tubes 24, remains on the bottom wall 18, and forms the filling bed just below the air diffuser tubes 24 due to the fluidizing medium 32 and the combustion residue 42 contained therein. The above-mentioned filling bed serves to adjust the thickness of the fluidized bed 40 which is formed above the air diffuser tubes 24. The filling bed, the thickness of which is increased by increment of the combustion residue, is discharged by the screw conveyor 46 which is installed below the filling bed. The screw conveyor 46 transfers the fluidizing medium 32 and the combustion residue 42 to the separator 44.

In the separator 44, the combustion residue 42 and the fluidizing medium 32 are separated by the sieve 48, where the combustion residue 42 is discharged from the discharge port 45 and the fluidizing medium 42 is recirculated to the fluidized bed 40 through the circulation line 50.

Figure 3:
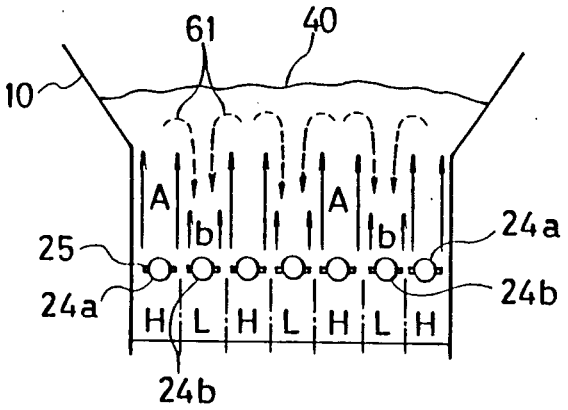
FIGS. 3 and 4 are sectional views showing the movement of the refuse and fluidizing medium within the fluidized bed.

Referring to FIG. 3, the fluidizing air is blown at high speed from the air diffuser tubes 24*a* respectively, as shown by the arrow "A", into the fluidized area 40, while low-speed fluidizing air is blown out through the air diffuser tubes 24*b* as shown by the arrow "b". Fluidized areas 40 above each of the air diffuser tubes 24*a* and 24*b*, of greater and lesser fluidization respectively, are formed alternately above air diffuser tubes 24*a* and 24*b*, and some of the refuse 28 above area "A" moves toward the less fluidized area, as shown by the arrow 61 and broken line in the figure. In the less fluidized area, a smaller amount of air is supplied to the refuse and the fluidizing medium 32 so that the refuse 28 is burned slowly.

Figure 4:
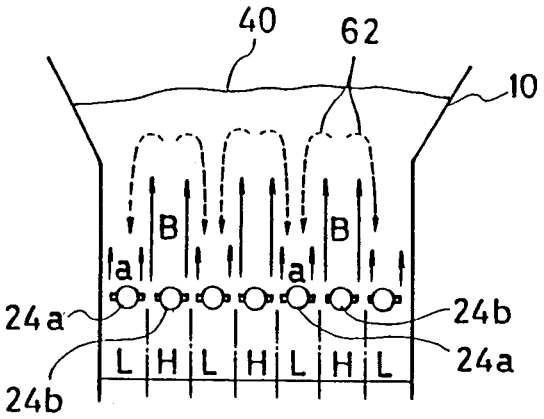

However, soon after the condition depicted in FIG. 3, if the speed of the fluidizing air from the air diffuser tubes 24*a* shown by the arrow "a" in FIG. 4 is slowed, and the speed of the fluidized air from the air diffuser tubes 24*b* as shown by the arrow "b" is increased, the condition shown in FIG. 3 is reversed so that the refuse 28 being slowly burned starts moving toward the more fluidized area which is shown by the arrow and broken line 62 in the figure.

By changing the condition of the fluidization using high and low-speed air from every air diffuser tube alternately and continuously, the refuse 28 within the fluidized bed 40 cannot only be agitated uniformly but can also be stably burned.

If the maximum speed of the air blown out of the air diffuser tubes is slower than the fluidizing starting speed, fluidizing does not occur; on the other hand, if the speed of the air is more than 2.5 times the fluidizing starting speed (um/umf>2.5) the void ratio of the refuse in the fluidized area becomes greater and accelerates combustion too much. However, when slowing down the speed of the air, it is preferable to keep its speed lower than 1.5 times that of the fluidizing starting speed "umf" or about half of the umf speed. When the ratio of um/umf is lower than 0.5, the speed at which the refuse 28 streams down between the air diffuser tubes 24*a*, 24*b* becomes greater than desired, thereby generating too much combustion residue.

Although five to seven air diffuser tubes 24 are described in connection with the above-discussed embodiment, it is to be understood that more or less such tubes may be employed.

It can be appreciated from the foregoing that the present invention provides the following benefits and advantages. First, the refuse can be slowly burned because a number of air diffuser tubes are installed in parallel in the incinerator body, and the fluidizing air is supplied from these air diffuser tubes at different speeds, i.e. high speed or low speed, and the speed is changed alternately at every other diffusion tube.

Second, because the fluidized area is fluidized to a greater or lesser extent, depending on the placement of the air diffuser tubes, and because the speed of air is changed, the refuse can be mixed uniformly, and the circulation of fluidizing medium inside the fluidized bed is thereby promoted. Thus, drying thermal decomposition and combusting the refuse inside the fluidized bed can be carried out slowly and stably.

Third, since the air ratio for combustion can be reduced, the combustion chamber temperature can be kept high, and the secondary combustion of pyrolysis gas can be accomplished more advantageously.

We claim:

1. A method of carrying out stable combustion in a fluidized bed incinerator for burning refuse, said fluidized bed incinerator being of the type including a plurality of spaced apart, parallel air diffuser tubes for introducing fluidizing air into the incinerator and a fluidizing medium for fluidizing said refuse about said air diffuser tubes in a fluidized bed, said method comprising the steps of:

supplying said fluidizing air at a high speed and at a low speed alternately from every other air diffuser tube;

periodically alternating the speed at which said fluidizing air is supplied from each of said air diffuser tubes between said high and low speeds;

quickly burning one portion of said refuse with said high speed fluidizing air while slowly burning another portion of said refuse with said low speed fluidizing air;

allowing combustion residue to descend through each space between adjacent ones of said air diffuser tubes; and decelerating the burning of said refuse in areas where said low speed fluidizing air flows past said combustion residue descending from areas where said high speed fluidizing air flows.

2. The method of claim 1, wherein said air diffuser tubes are arranged in first and second alternating sets respectively connected to first and second headers, and the fluidizing air is supplied alternately at high pressure and low pressure to the first header and to the second header.

3. The method of claim 1, wherein said fluidizing air is supplied from longitudinally spaced points on opposite sides of each of said air diffuser tubes.

4. The method of claim 1, wherein the speed of said fluidizing air supplied at high speed from said air diffuser tubes is 1.0 to 2.5 times the fluidizing air speed required to start fluidization of said refuse and fluidizing medium, and the speed of said fluidizing air supplied at low speed is 0.5 to 1.5 times that of the fluidization starting speed.

5. The method of claim 1, wherein the fluidized areas for said refuse and fluidizing medium formed about the air diffuser tubes from which high speed air is supplied are more fluidized than less fluidized areas formed about the air diffuser tubes from which low speed air is supplied, and the more and less fluidized areas are formed alternately.

6. The method of claim 1, wherein pyrolysis gas is generated by thermal decomposition of said refuse inside said fluidized bed and the method includes the step of burning said pyrolysis gas by supplying secondary air to an upper section of said incinerator.

7. The method of claim 6, wherein the total volume of said fluidizing air supplied to said fluidized bed and said secondary air supplied to said upper section of said incinerator is 1.4 to 1.7 times that of the theoretical air volume of said refuse.

8. The method of claim 7, wherein said fluidizing air and said secondary air are supplied approximately at the rate of 1:1 in volume.

* * * * *